US006926276B1

(12) United States Patent
Zocchi

(10) Patent No.: US 6,926,276 B1
(45) Date of Patent: Aug. 9, 2005

(54) BRAKING SYSTEM FOR DICE

(76) Inventor: Louis J. Zocchi, 7604 Newton Dr., Biloxi, MS (US) 39532-2830

( * ) Notice: Subject to any disclaimer, the term of this patent is extended or adjusted under 35 U.S.C. 154(b) by 15 days.

(21) Appl. No.: 10/680,312

(22) Filed: Oct. 8, 2003

(51) Int. Cl.[7] ..... A63F 9/04
(52) U.S. Cl. ..... 273/146; 273/145 CA; D21/372; D21/373
(58) Field of Search ..... 273/146, 145 CA, 273/145 R; D21/372, 373

(56) References Cited

U.S. PATENT DOCUMENTS 3,198,523 A 8/1965 Stimson
3,655,197 A * 4/1972 Milbaum ..... 273/146
4,546,978 A * 10/1985 David ..... 273/146
D303,553 S * 9/1989 Zocchi ..... D21/373
5,018,738 A * 5/1991 Padi ..... 273/146
D323,684 S 2/1992 Thompson
5,556,096 A 9/1996 Eardley et al.
D410,038 S 5/1999 Golad et al.
6,109,608 A 8/2000 Golad

* cited by examiner

*Primary Examiner*—Benjamin Layno
(74) *Attorney, Agent, or Firm*—George L. Williamson

(57) ABSTRACT

The present invention discloses a multi-sided dice having a braking system consisting of a plurality of effectively sized and numbered particles disposed internal of the dice so that as the dice rolls along a surface, the particles frictionally slow the dice. The dice also comprises 100 sides. The dice of the present invention are comprised of a pair of semi-circular halves having inner and outer shells which are attached to each other around the equator of the spherical dice.

6 Claims, 2 Drawing Sheets

BRAKING SYSTEM FOR DICE

BACKGROUND OF THE INVENTION

1. Field of the Invention

The present invention relates generally to dice and, more specifically, is concerned with a braking system for dice.

2. Description of the Prior Art

Multi-sided dice have been described in the prior art; however, none of the prior art devices disclose the unique features of the present invention.

In U.S. Pat. No. 3,198,523, dated Aug. 3, 1965, Stimson disclosed a set of dice comprising four dice, divided, grouped and paired into playing dice and reserve dice. Each of the dice is in the form of an octahedron having eight, flat, similarly-shaped triangular faces. The faces are preferably in the form of equilateral triangles although isosceles triangles can also be used. The particular shape of each face is relatively unimportant so long as each has the same tendency because of its geometry to come to rest upon the surface on which the dice are thrown and this can be most economically accomplished by using the aforementioned triangular shapes. Each die comprises two hollow halves having a partition between them which encloses in one of the halves a weighting ball of a heavy material such as lead.

In U.S. Pat. No. 5,556,096, dated Sep. 17, 1996, Eardley, et al., disclosed dice which are generally spherical and which have a multiplicity of flat faces bearing indicia—symbols, letters, numerals or the like formed thereon by cutting, etching or engraving. The faces are arranged in opposed identical pairs with their centers lying on axes passing through the center of the die. In passing through the center of the die the axes may be symmetrically spaced one from the other or be arranged such that their angular spacing in both bearing and elevation is maximized.

In U.S. Pat. No. 6,109,608, dated Aug. 29, 2000, Golad disclosed a die or dice having an outer surface with four faces. The faces are arranged contiguously so as to form a single generally spherical body. Each face has at least in part the shape of a segment of a sphere and carries identifying indicia. The center of each face is located on the angular points of a symmetrical tetrahedron. Any three of the four faces, which faces are situated mutually in pairs adjacent one another, touch one another at a trihedral point. The trihedral point is situated diametrically with regard to the fourth face. The die is provided on its outer surface with four support positions. Each support position has as a center the trihedral point.

In U.S. Pat. No. Des. 410,038, dated May 18, 1999, Golad, et al., disclosed the ornamental design for a die, as shown and described.

In U.S. Pat. No. Des. 323,684, dated Feb. 4, 1992, Thompson disclosed the ornamental design for a fifty-sided die, as shown and described.

In U.S. Pat. No. Des. 303,553, dated Sep. 19, 1989, Zocchi disclosed an ornamental design for a spherically shaped game die as shown and described.

While these multi-sided dice may be suitable for the purposes for which they were designed, they would not be as suitable for the purposes of the present invention, as hereinafter described.

SUMMARY OF THE PRESENT INVENTION

The present invention discloses a multi-sided dice having a braking system consisting of a plurality of effectively sized and numbered particles disposed internal of the dice so that as the dice rolls along a surface, the particles frictionally slow the dice. The dice also comprises 100 sides. The dice of the present invention are comprised of a pair of semi-circular halves having inner and outer shells which are attached to each other around the equator of the spherical dice.

An object of the present invention is to provide a multi-sided dice. A further object of the present invention is to provide a braking system for the dice so that the length of roll of the dice is reduced. A further objective of the present invention is to provide a fair sided dice so that the probability of any number appearing is equal to the probability of any other number appearing on the dice.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
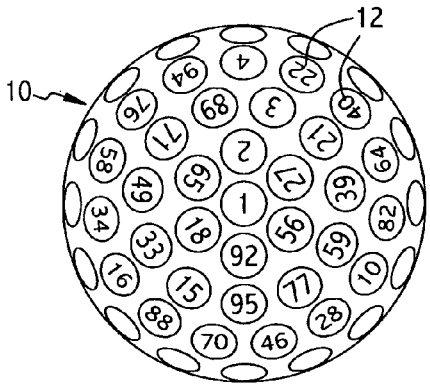
FIG. 1 is a plan view of the present invention.

With regard to reference numerals used, the following numbering is used throughout the drawings.

10 present invention
12 facets
14 upper half
16 lower half
18 particles
20 outer shell
22 inner shell
24 protrusion
26 aperture
28 protrusion
30 recess
32 recess
34 prior art dice
36 surface
38 hand
A distance
B distance

DETAILED DESCRIPTION OF THE PREFERRED EMBODIMENT

Turning now descriptively to the drawings, in which similar reference characters denote similar elements throughout the several views wherein a multi-sided dice having a braking system is disclosed.

Figure 2:
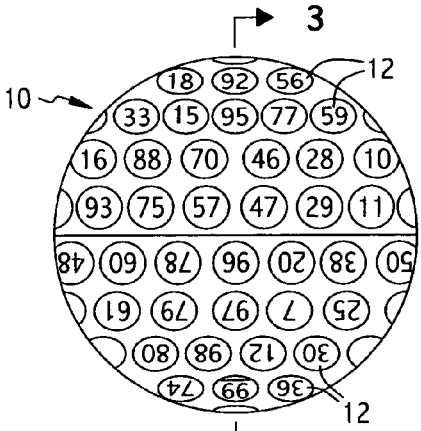
FIG. 2 is a side view of the present invention.
Figure 3:
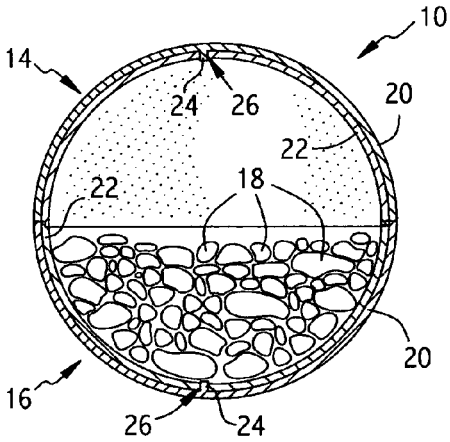
FIG. 3 is cross sectional view of the present invention.

Turning to FIGS. 1 through 3, shown therein is the present invention 10 being a spherically shaped dice having a plurality of facets 12 thereon wherein each facet is individually numbered from one to one hundred being a dice having 100 sides. The likelihood of any number appearing or being rolled using the present invention is substantially the same as the likelihood of any other number.

Turning to FIG. 3, shown therein is the present invention 10 having an upper 14 and lower 16 half or part wherein the parts are joined at the equator of the present invention. Each half 14, 16 has an outer shell 20 and an inner shell 22. Also shown are a plurality of effectively sized and numbered particles 18 disposed internal the present invention 10 which acts or forms a braking system for the present invention. The purpose of the braking system is to reduce the length of roll necessary for the dice of the present invention 10 to come to a stop. The outer shell 20 a has protrusion 24 thereon which joins to an inner shell aperture 26 in order to join the shells 20, 22.

Figure 4:
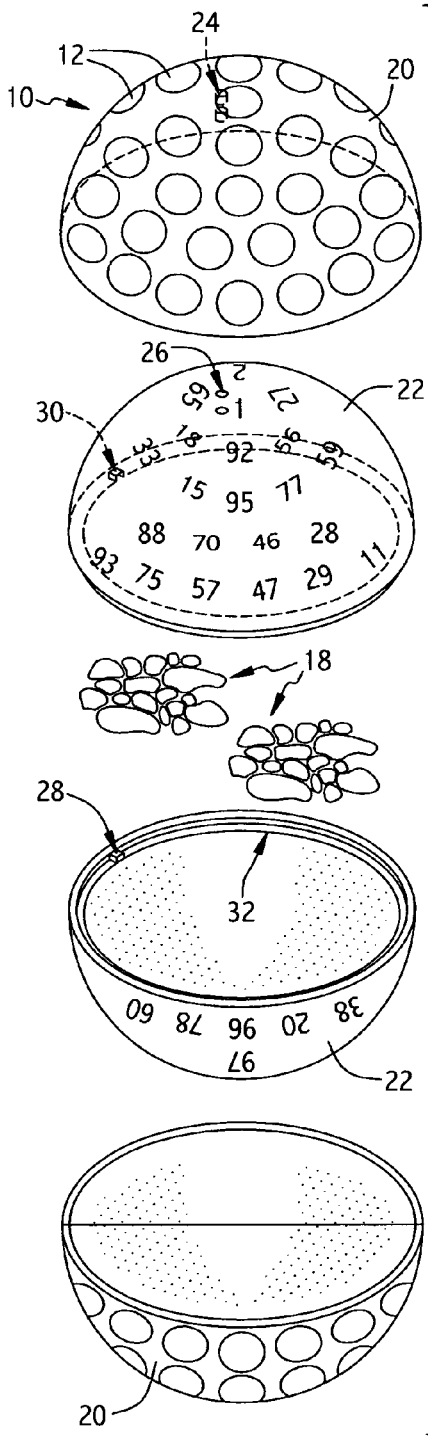
FIG. 4 is an exploded view of the present invention.

Turning to FIG. 4, shown therein is an exploded view of the present invention 10 showing the construction of the present invention wherein the upper half 14 is composed of an outer member 20 and an inner member 22 and the lower half 16 is composed of an outer member 20 and an inner member 22. Also shown is the plurality of particles 18 disposed internal the cavity formed on the interior of the present invention 10. Also shown is protrusion 24 and one or two apertures 26 for joining shells 20, 22 along with another protrusion 28 and recess 30 for joining the upper 14 and lower 16 halves together. Also shown is a recess 32 formed at the equator of the present invention 10 so that the shells 20, 22 can be frictionally joined or press fit together whereas the halves 14, 16 are expected to be sonicly welded together. The numbers are printed on the outer surface of inner shells 22 to keep them from being worn away and the facets 12 are formed on the outer shell 20 which is transparent to be able to see the numbers.

Figure 5:
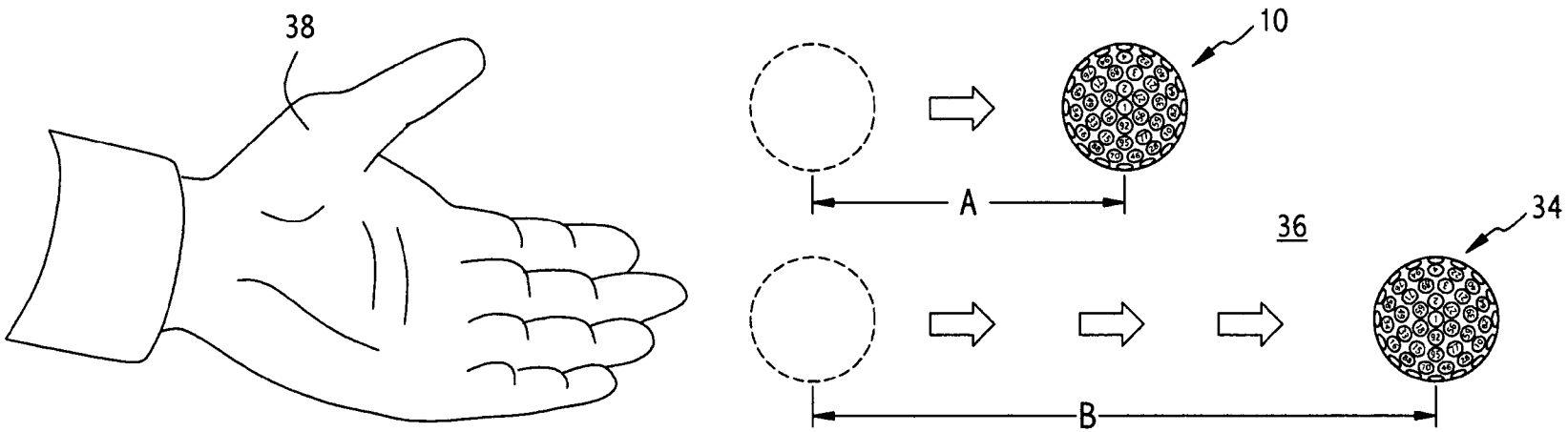
FIG. 5 is an illustration of the present invention in use.

Turning to FIG. 5, shown therein is the present invention 10 and a similar prior art dice 34 without a braking system being rolled on a surface 36 from a hand 36. Distances A and B illustrate the distance the dice 10, 34 will roll before they come to a complete stop.

It is believed that the present invention 10 works due to the friction created by the particles 18 being tumbled against each other and the inner wall of the present invention wherein the present invention is braked by the particles as it rolls on a surface.

I claim:

1. A dice, comprising:

a) a spherical dice having a plurality of faces, wherein each of said faces has at least one number disposed thereon, wherein each of said faces has substantially an equal chance of being rolled on each cast of the dice;

b) an upper and lower half, wherein each said half has an inner shell and an outer shell, wherein the dice has a cavity therein;

c) wherein said inner and outer shells are joined together and said upper and lower halves are joined together;

d) a braking system being disposed in said cavity, wherein the dice is braked as the dice rolls on a surface; and, e) wherein said braking system comprises multi sized and irregularly shaped particles so that the dice is braked as the dice rolls on a surface.

2. The dice of claim 1, wherein there are 100 faces, wherein each of said 100 faces has substantially an equal chance of being rolled on each cast of the dice.

3. The dice of claim 1 in which said spherical dice is formed of an inner shell and an outer shell, said faces being on said outer shell and said numerals are on said inner shell with said faces lined up with said numerals, said faces being transparent so that said numerals are visible.

4. The dice of claim 3 in which each of said inner and outer shells is made of upper and lower halves which are joined together to form said spherical dice.

5. The dice of claim 4 in which said particles substantially fill up one of the halves of the inner shell.

6. The dice of claim 5 in which the inner shell has a smooth inner surface.

* * * * *